US010279963B2

(12) United States Patent
Kalmanides

(10) Patent No.: US 10,279,963 B2
(45) **Date of Patent: *May 7, 2019**

(54) TAMPER-EVIDENT CONTAINER AND METHOD

(71) Applicant: SABERT CORPORATION, Sayreville, NJ (US)

(72) Inventor: Danny Kalmanides, Chapel, NC (US)

(73) Assignee: SABERT CORPORATION, Sayreville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/979,126

(22) Filed: May 14, 2018

(65) Prior Publication Data

US 2018/0257825 A1 Sep. 13, 2018

Related U.S. Application Data

(63) Continuation of application No. 14/730,678, filed on Jun. 4, 2015, now Pat. No. 9,981,782.

(51) Int. Cl.
*B65D 43/02* (2006.01)

(52) U.S. Cl.
CPC ..... *B65D 43/0239* (2013.01); *B65D 43/0241* (2013.01); *B65D 2543/0062* (2013.01); *B65D 2543/00101* (2013.01); *B65D 2543/00296* (2013.01); *B65D 2543/00453* (2013.01); *B65D 2543/00462* (2013.01); *B65D 2543/00685* (2013.01); *B65D 2543/00731* (2013.01); *B65D 2543/00796* (2013.01); *B65D 2543/00842* (2013.01)

(58) Field of Classification Search
CPC ..... B65D 43/0239; B65D 43/0241; B65D 2543/00453; B65D 2543/00796; B65D 2543/00462; B65D 2543/00731; B65D 2543/00685; B65D 2543/00842; B65D 2543/00296; B65D 2543/00101; B65D 2543/0062
USPC ..... 220/270
See application file for complete search history.

(56) References Cited

U.S. PATENT DOCUMENTS 2,915,215 A 12/1959 Frankel
5,507,406 A 4/1996 Urciuoli et al.
(Continued)

FOREIGN PATENT DOCUMENTS

WO WO 90/14999 12/1990

OTHER PUBLICATIONS

Search Report dated Oct. 13, 2016 issued in the corresponding European Patent Application No. 16172732.6.
(Continued)

*Primary Examiner* — James N Smalley
(74) *Attorney, Agent, or Firm* — Cozen O'Connor

(57) ABSTRACT

A tamper-evident container and method is disclosed. The tamper-evident container includes a base portion and a lid (or cover). In an untampered with state, one edge of the lid is removably connected to one edge of the base portion. Namely, the lid includes a tamper-evident tab, wherein the tamper-evident tab includes a grasping overhanging portion that is flanked by at least one breakable joint and wherein the lid is removably connected to the base portion via the breakable joint of the tamper-evident tab. Further, the tamper-evident container comprises an interlocking interface between the base portion and the lid. A method of using the tamper-evident container is provided.

20 Claims, 20 Drawing Sheets

(56) References Cited

U.S. PATENT DOCUMENTS

| | | | |
|---|---|---|---|
| 6,926,165 | B2 | 8/2005 | Conti |
| 7,073,680 | B2 | 7/2006 | Boback et al. |
| 7,118,003 | B2 | 10/2006 | Sellari et al. |
| 7,568,589 | B2 | 8/2009 | Vovan |
| 7,712,626 | B2 | 5/2010 | Vovan |
| 7,816,353 | B2 | 10/2010 | Cheng et al. |
| 7,992,743 | B2 | 8/2011 | Vovan |
| 8,056,750 | B2 | 11/2011 | Vovan |
| 8,240,505 | B1 | 8/2012 | Chen |
| 8,251,249 | B1 | 8/2012 | Vovan |
| 8,272,526 | B1 | 9/2012 | Vovan et al. |
| 8,608,008 | B2 | 12/2013 | Gingras et al. |
| 8,795,580 | B2 | 8/2014 | Sellari et al. |
| 9,016,503 | B2 | 4/2015 | Barbier et al. |
| 9,493,227 | B2 | 11/2016 | Helou, Jr. |
| 2005/0184070 | A1 | 8/2005 | Boback et al. |
| 2006/0289549 | A1 | 12/2006 | Vovan |
| 2007/0045317 | A1 | 3/2007 | Rosender et al. |
| 2007/0138180 | A1 | 6/2007 | Vovan |
| 2009/0120942 | A1 | 5/2009 | Vovan |
| 2010/0102074 | A1 | 4/2010 | Parikh et al. |
| 2010/0140267 | A1 | 6/2010 | Sellari |
| 2013/0020325 | A1 | 1/2013 | Stone et al. |
| 2013/0043247 | A1 | 2/2013 | Nikaein |
| 2014/0138383 | A1 | 5/2014 | Lisowy et al. |
| 2014/0190970 | A1 | 7/2014 | Huang |
| 2014/0224804 | A1 | 8/2014 | Pickering |
| 2014/0300034 | A1 | 10/2014 | Sellari et al. |
| 2015/0028033 | A1 | 1/2015 | Samuel |
| 2015/0060455 | A1 | 3/2015 | Chou |
| 2015/0266611 | A1 | 9/2015 | Dow et al. |

OTHER PUBLICATIONS

Office Action dated Jun. 1, 2016 issued in U.S. Appl. No. 15/015,525.
Search Report and Written Opinion dated Mar. 22, 2017 issued in International Patent Application No. PCT/US16/66679.
Office Action dated Jul. 27, 2017 issued in U.S. Appl. No. 15/015,525.
Office Action dated Aug. 2, 2017 issued in Canadian Patent Application No. 2,931,803.

A-A

A-A

TAMPER-EVIDENT CONTAINER AND METHOD

CROSS REFERENCE TO RELATED APPLICATIONS

This application is a continuation of U.S. patent application Ser. No. 14/730,678 which was filed with the U.S. Patent and Trademark Office on Jun. 4, 2015.

TECHNICAL FIELD

The presently disclosed subject matter relates generally to containers and more particularly to a tamper-evident container and method.

BACKGROUND

Disposable containers for packaging, distributing, displaying or otherwise housing consumer items, especially perishable foods, arc becoming increasingly important. Containers with lids arc used to store virtually any type of product (e.g., foodstuffs, medicine, and the like) for later use and/or sale. Unfortunately, it is a frequent occurrence that containers are tampered with by persons who wish to tamper with the goods or products that are stored in the packages. In taking steps to avoid this invasion of the container, many approaches in the nature of security and/or safety have been utilized. However, some of these security attempts have been easily circumvented, some have been so cumbersome as to make the container virtually useless, and others have been very expensive.

One of the desirable features of security packaging is to have a package which is very secure so as to be considered "tamper proof." Also important is the characteristic that any tampering with the package produces a "tamper evident" condition. With a "tamper evident" condition, a consumer can, with almost casual visual observation, detect that the container has been tampered with even though the "tamper proof" aspects thereof have not been breached. Unfortunately, many security attempts have been unsuccessful in that it is not fully evident that the security of the container has been breached. Consequently, new approaches arc needed for providing tamper proof containers that incorporate tamper-evident features.

SUMMARY

In an aspect, the presently disclosed subject matter provides a tamper-evident container comprising (a) a base comprising a recessed tab comprising a first grasping portion; (b) a lid comprising a tamper-evident tab at least partially overhanging the recessed tab, the tamper-evident tab comprising a second grasping portion flanked by a first breakable joint between the base and the lid; and (c) an interlocking interface formed between the base and the lid, wherein when the container is closed the interlocking interface renders contents inside the container substantially inaccessible without severing the first breakable joint and/or evidencing tampering with the container; and wherein the first breakable joint is at least partially severed when the second grasping portion is displaced relative to the first grasping portion, thereby evidencing tampering with the container.

In some embodiments, the recessed tab further comprises a recess for receiving a fingertip and a wall portion onto which one portion of the fingertip rests when an adjacent portion of the same fingertip is used to grasp the first grasping portion.

In some embodiments, the tamper-evident tab is flanked by a second breakable joint between the base and the lid. In some embodiments, the first breakable joint and the second breakable joint each comprise: (i) a tab portion, (ii) a flap portion, and (iii) a score line or perforation defining a bend between the tab portion and the flap portion. In some embodiments, when the first breakable joint and/or the second breakable joint is severed, the tab portion remains stationarily adjoined to the lid, and the flap portion remains hingeably adjoined to the base, thereby evidencing tampering with the container. In some embodiments, when the first breakable joint and/or the second breakable joint is not severed, the flap portion partially obstructs a recess defined in part by the recessed tab. In some embodiments, when the first breakable joint and/or the second breakable joint is intact, the bend pulls the second grasping portion toward the first grasping portion.

In some embodiments, the lid further comprises a radially projecting peripheral flange adjoining the tamper-evident tab, and wherein the base further comprises a surround portion surrounding the lid when the container is closed, the surround portion comprising an outer peripheral face that is parallel to a plane P, and an inner peripheral face opposite the outer peripheral face.

In some embodiments, the interlocking interface comprises a lock formed between an inverted ridge positioned adjacent to the radially projecting peripheral flange of the lid and a groove positioned adjacent to the inner peripheral face of the surround portion of the base. In some embodiments, the inner peripheral face comprises a stepped portion, and wherein the groove is defined in part by the stepped portion. In some embodiments, the base comprises a plurality of repeating plateaus opposite the stepped portion, and the groove is further defined in part by the plurality of repeating plateaus. In some embodiments, the inverted ridge is reversibly snap-fitted into the groove.

In some embodiments, the interlocking interface comprises a lock formed between the inner peripheral face and the radially projecting peripheral flange. In some embodiments, the inner peripheral face comprises an undercut face portion and a stepped face portion combining to form a vertex therebetween. In some embodiments, the radially projecting peripheral flange is reversibly snap-fitted into the vertex. In some embodiments, the undercut face portion is set at an angle $\alpha$ of about 14° relative to the plane P.

In an aspect, the presently disclosed subject matter provides a tamper-evident container comprising: (a) a base comprising a recessed tab comprising a first grasping portion; (b) a lid comprising a tamper-evident tab at least partially overhanging the recessed tab, the tamper-evident tab comprising a second grasping portion flanked by breakable joints between the base and the lid; and (c) an interlocking interface formed between the base and the lid, wherein when the container is closed the interlocking interface renders contents inside the container relatively inaccessible without severing the breakable joints and/or evidencing tampering with the container; and wherein the breakable joints are at least partially severed when the second grasping portion is displaced relative to the first grasping portion, thereby evidencing tampering with the container.

In some embodiments, the breakable joints each comprise: (i) a tab portion, (ii) a flap portion, and (iii) a score line or perforation defining a bend between the tab portion and the flap portion.

In some embodiments, when the breakable joints arc severed, the tab portions remain stationarily adjoined to the lid, and the flap portions remains hingeably adjoined to the base, thereby evidencing tampering with the container. In some embodiments, when the breakable joints are intact, the flap portions partially obstructs a recess defined in part by the recessed tab. In some embodiments, when the breakable joints are intact, the bends pull the second grasping portion toward the first grasping portion, thereby minimizing the footprint of the container.

In some embodiments, the lid further comprises a radially projecting peripheral flange adjoining the tamper-evident tab, wherein the base further comprises a surround portion surrounding the lid when the container is closed, the surround portion comprising an outer peripheral face that is parallel to a plane P, and an inner peripheral face opposite the outer peripheral face, and wherein the inner peripheral face comprises an undercut face portion and a stepped face portion.

In some embodiments, the base further comprises a groove that is defined on one side by the stepped face portion and is defined on the opposite side by a plurality of repeating plateaus, wherein the lid further comprises an inverted ridge positioned adjacent the radially projecting peripheral flange, and wherein the interlocking interface comprises a lock formed by the reversible snap-fitted engagement between the inverted ridge and the groove when the container is closed.

In some embodiments, the undercut face portion is set at an angle $\alpha$ relative to the plane P, thereby forming a vertex between the undercut face portion and the stepped face portion of the inner peripheral face, wherein the interlocking interface comprises a lock formed by the reversible snap-fitted engagement between the radially projecting flange and the vertex when the container is closed. In some embodiments, the undercut face portion is set at an angle $\alpha$ of about 14° relative to the plane P.

In an aspect, the presently disclosed subject matter provides a method of evidencing tampering with a tamper-evident container, the method comprising: (a) providing a tamper-evident container, the tamper-evident container comprising: (i) a base comprising recessed tab comprising a first grasping portion; (ii) a lid comprising a tamper-evident tab at least partially overhanging the recessed tab, the tamper-evident tab comprising a second grasping portion flanked by breakable joints between the base and the lid, the breakable joints each comprising a tab portion that remains stationarily adjoined to the lid when the breakable joints are severed, and a flap portion that remains hingeably adjoined to the base when the breakable joints are severed; and (iii) an interlocking interface formed between the base and the lid, wherein when the container is closed the interlocking interface renders contents inside the tamper-evident container inaccessible without severing the breakable joints and/or evidencing tampering with the container, and wherein the breakable joints arc at least partially severed by displacing the second grasping portion relative to the first grasping portion until at least one of the tab portions is partially separated from at least one of the flap portions, thereby evidencing tampering with the container; (b) instructing a user of the tamper-evident container to grasp the first grasping portion and/or the second grasping portion; and (c) evidencing tampering with the container when the second grasping portion is displaced relative to the first grasping portion until at least one of the tab portions is partially separated from at least one of the flap portions.

In some embodiments, the step (b) of instructing the user of the tamper-evident container to grasp the first grasping portion and/or the second grasping portion comprises providing indicia on the first grasping portion and/or the second grasping portion that visually cues the user to grasp the first grasping portion and/or the second grasping portion. In some embodiments, the indicia optionally visually cues the user to displace the first grasping portion relative to the second grasping portion.

Certain aspects of the presently disclosed subject matter having been stated hereinabove, which arc addressed in whole or in part by the presently disclosed subject matter, other aspects will become evident as the description proceeds when taken in connection with the accompanying Examples and Drawings as best described herein below.

BRIEF DESCRIPTION OF THE DRAWINGS

Figure 1:
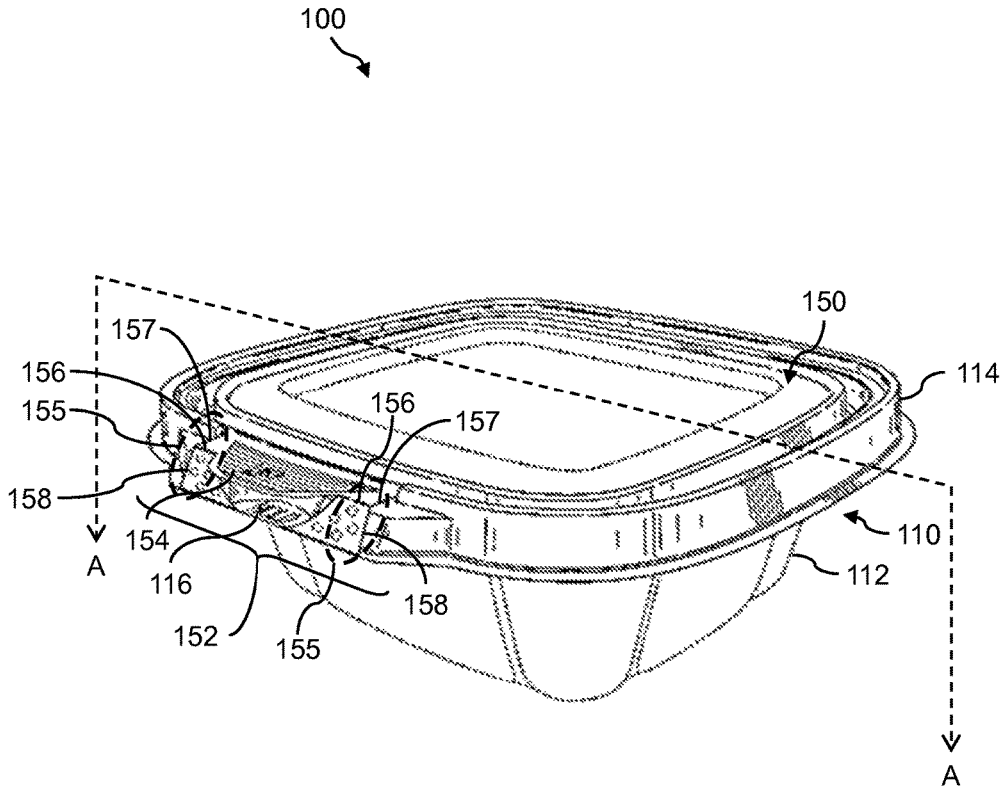
Figure 2:
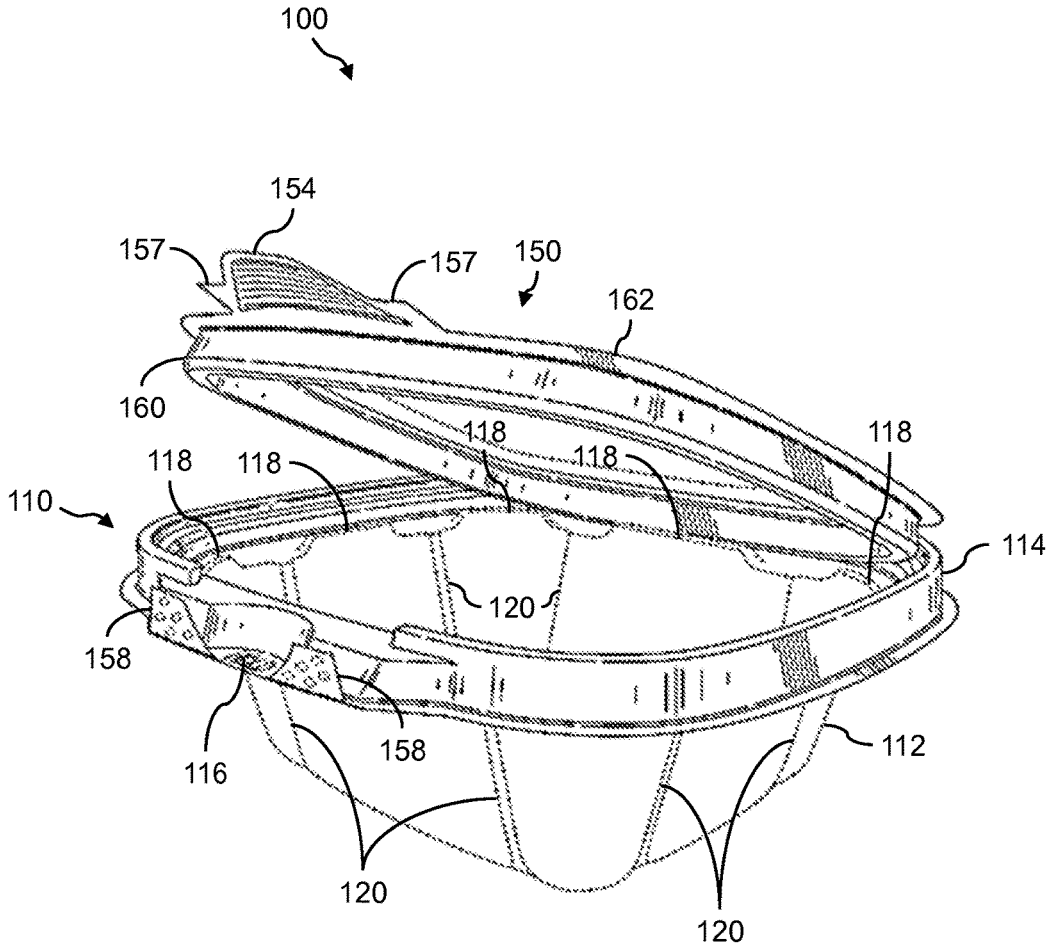
Figure 3:
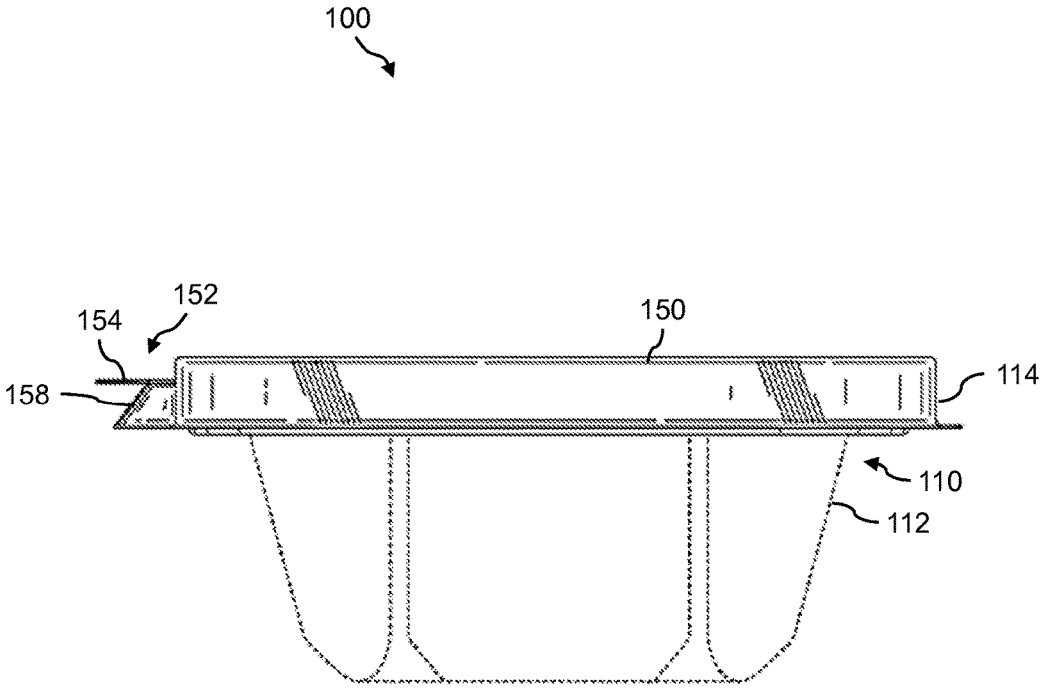
Figure 4:
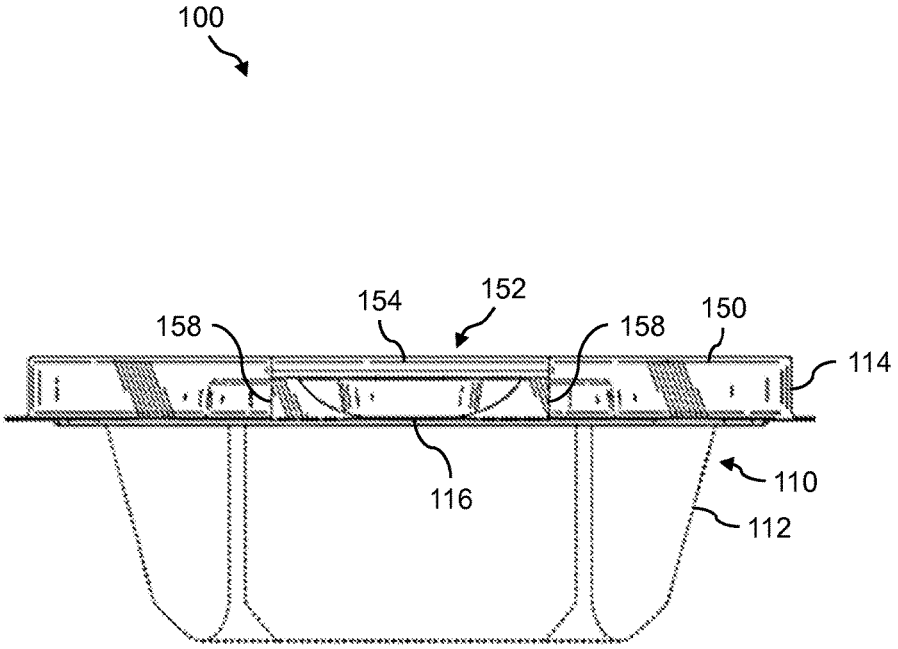
Figure 5:
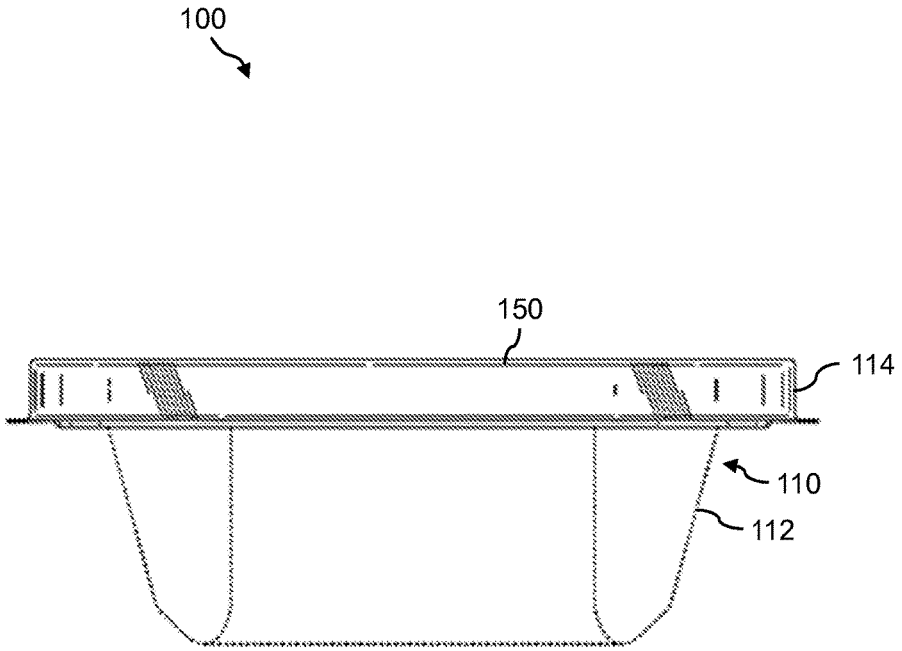
Figure 6:
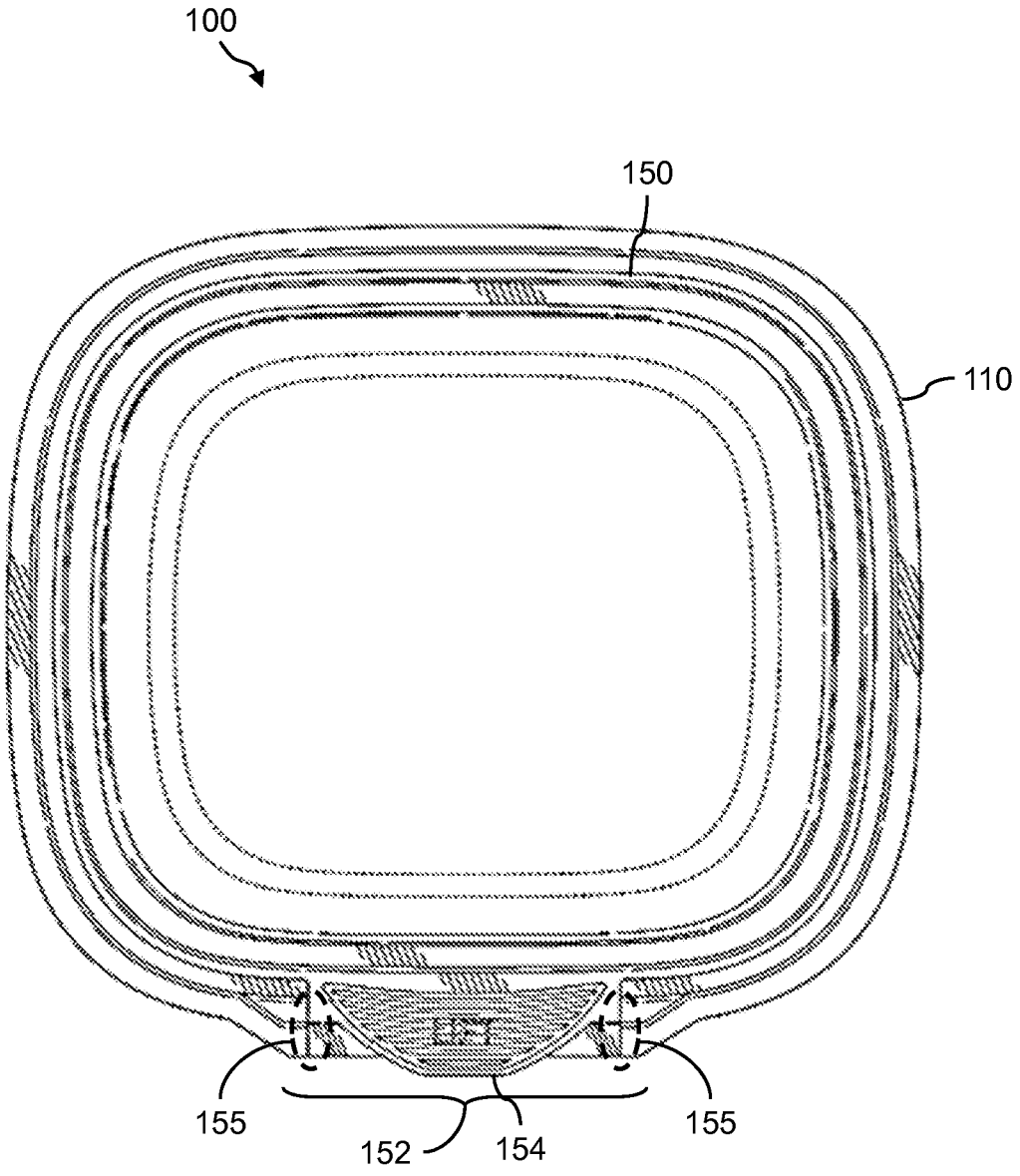
Figure 7:
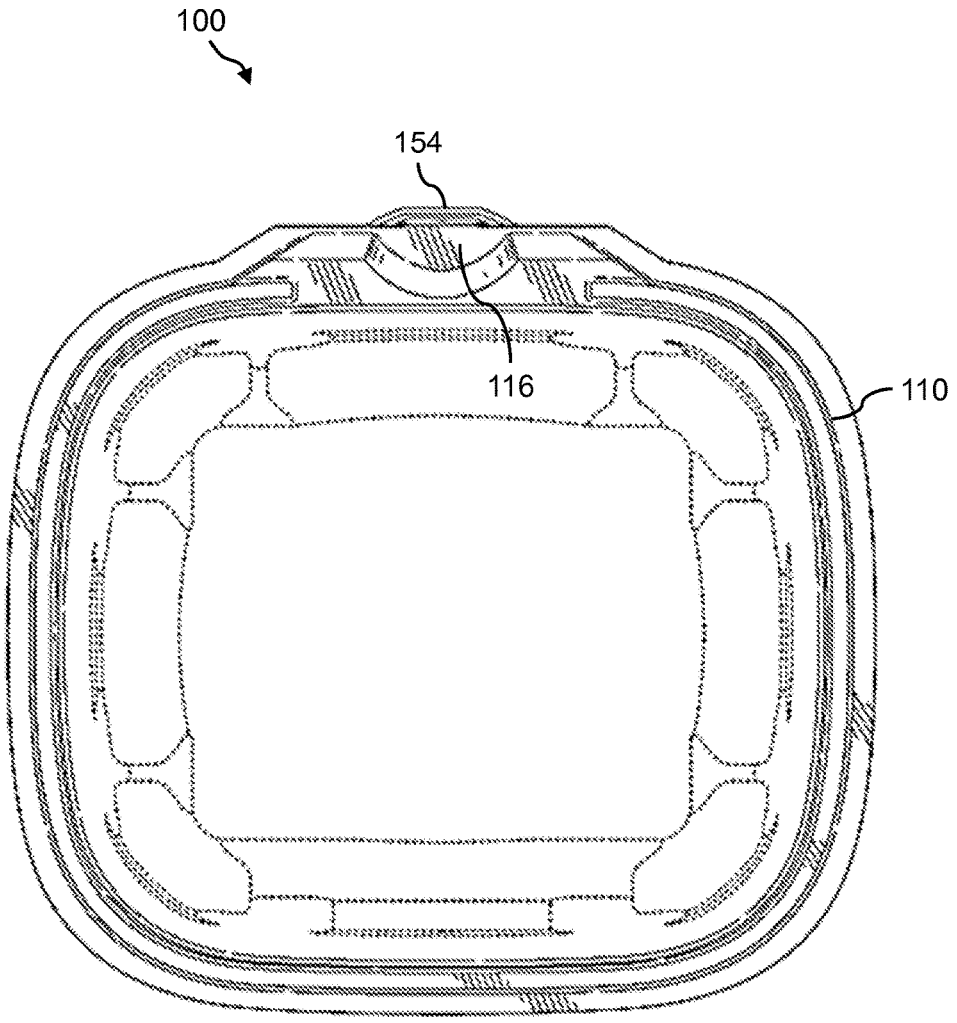
Figure 8:
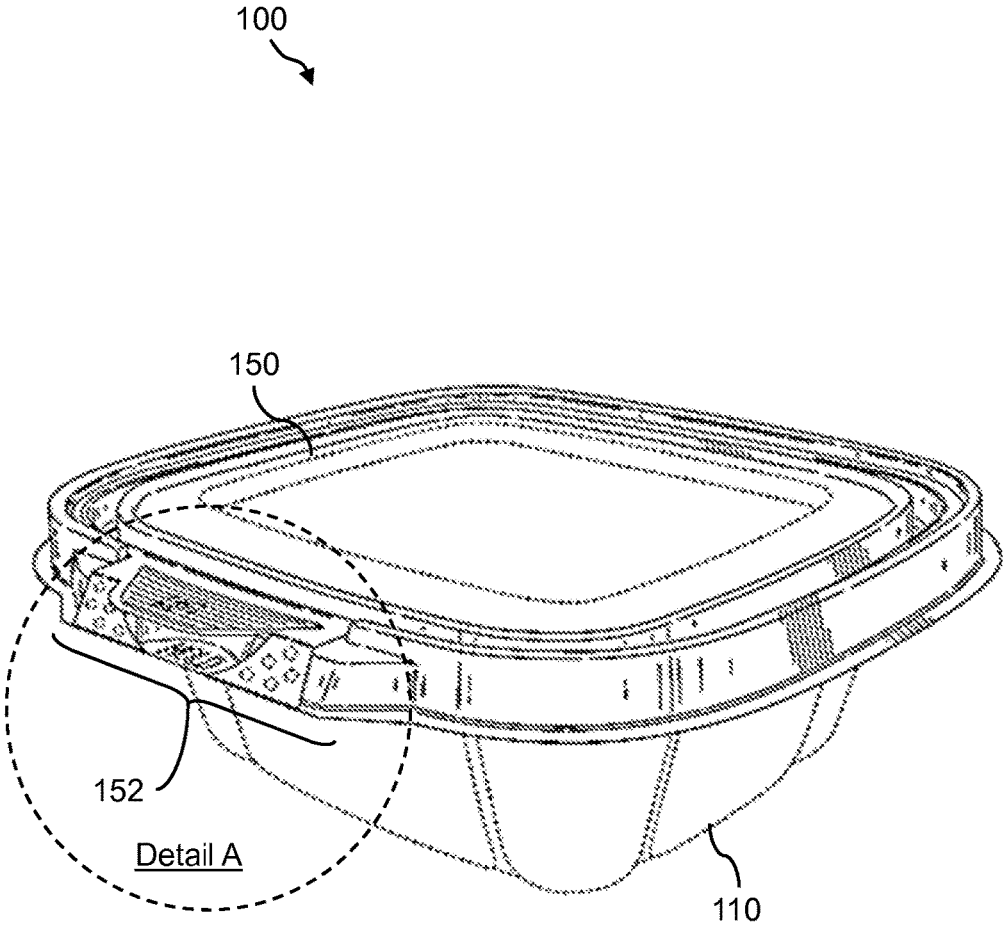
Figure 9:
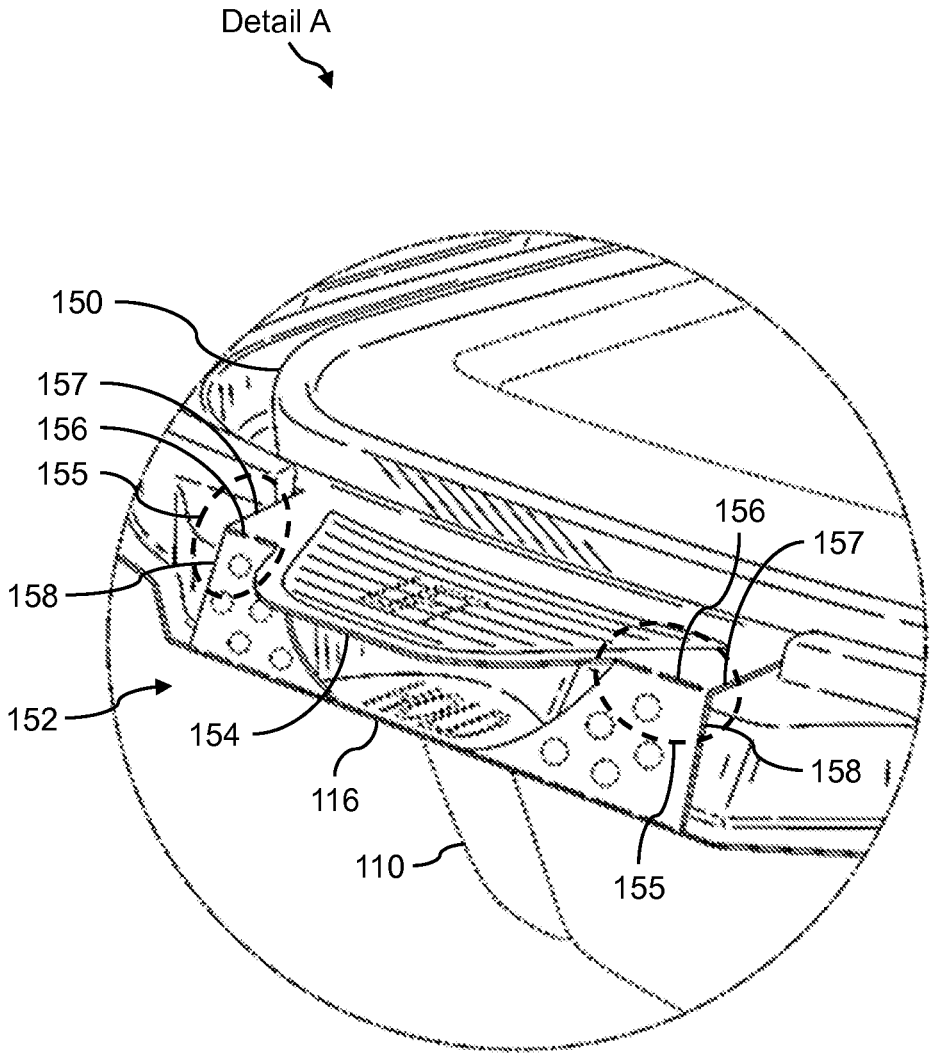
Figure 10:
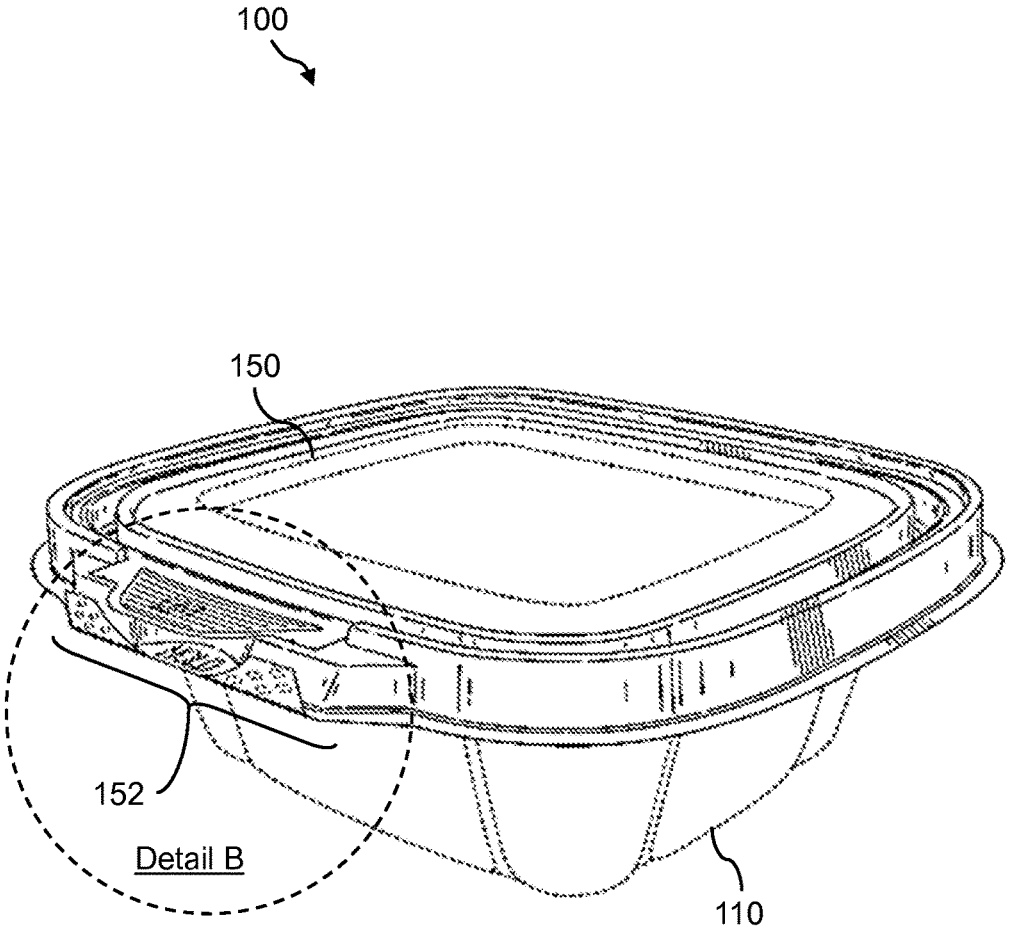
Figure 11:
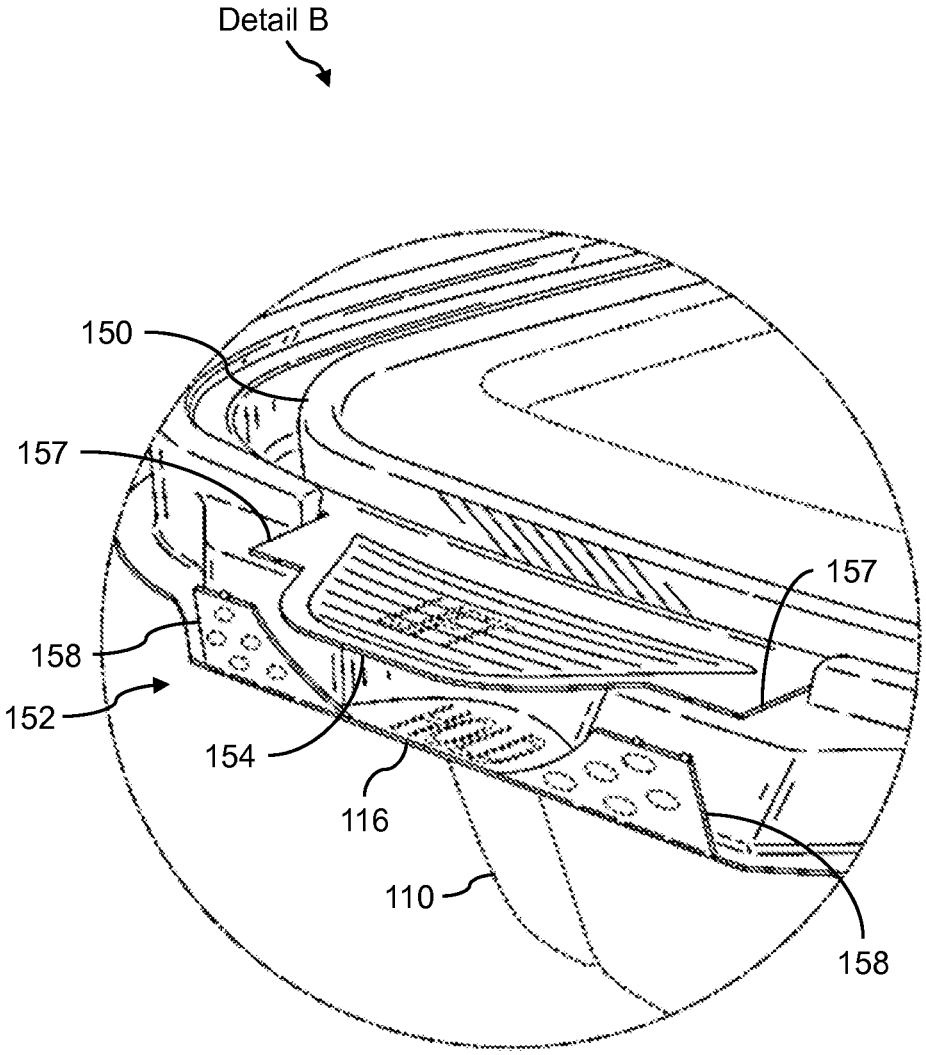
Figure 12:
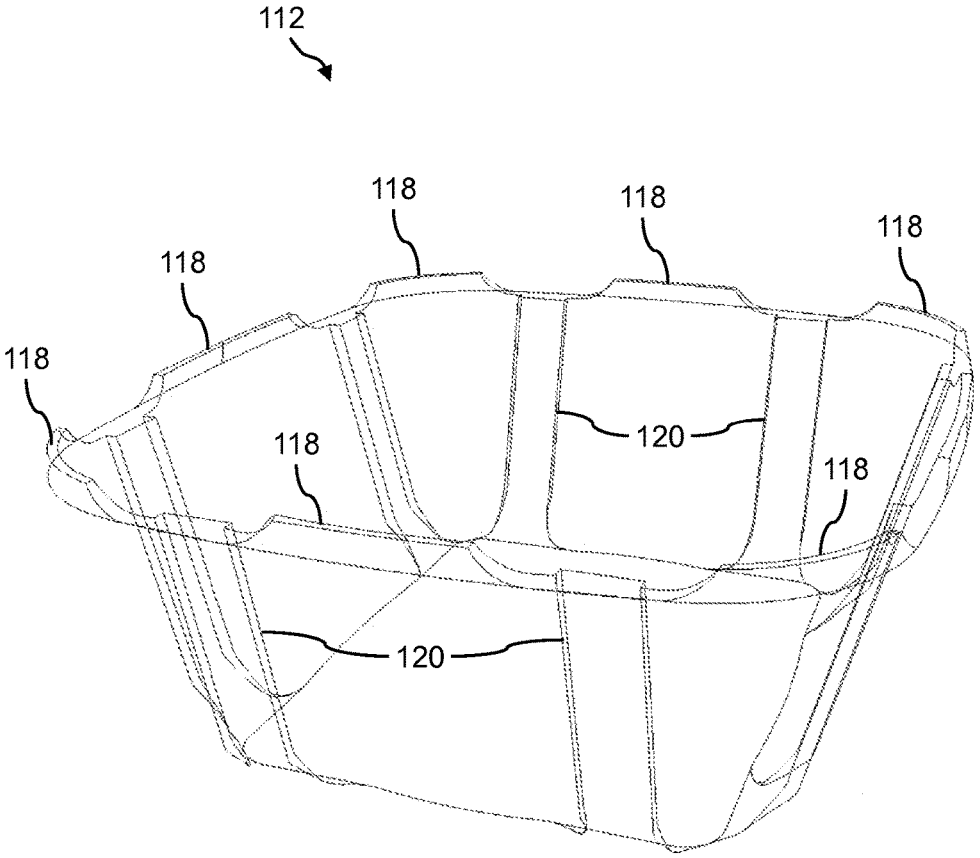
Figure 13:
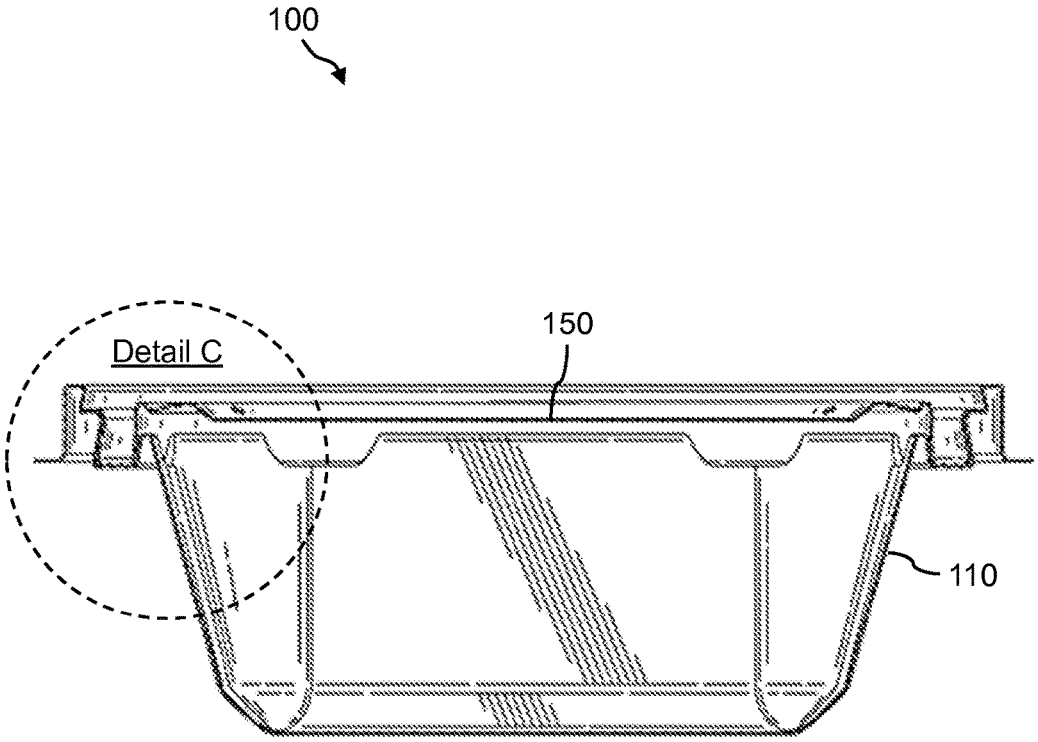
Figure 14:
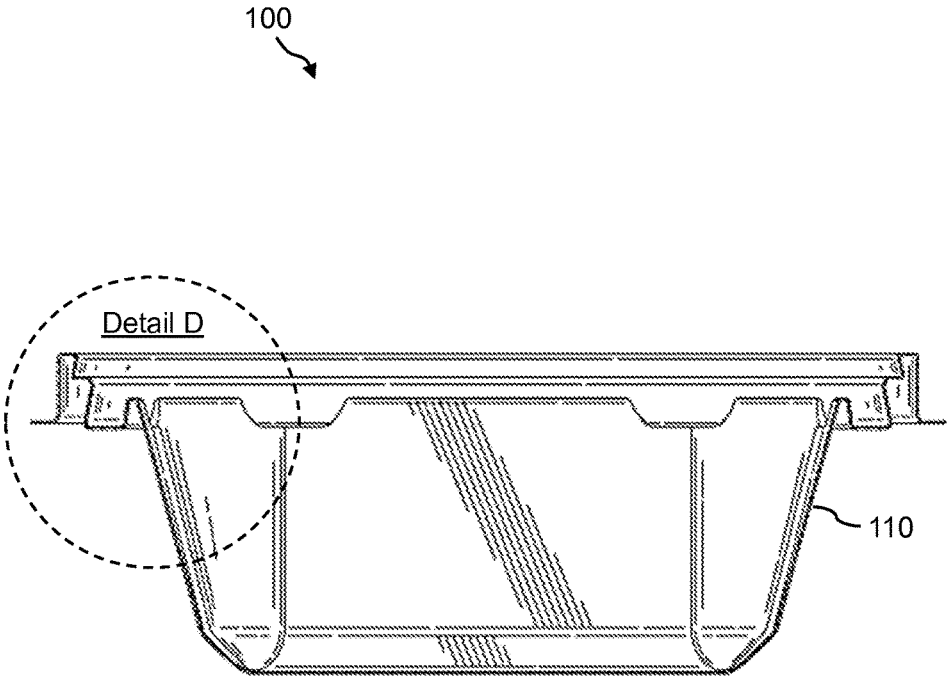
Figure 15:
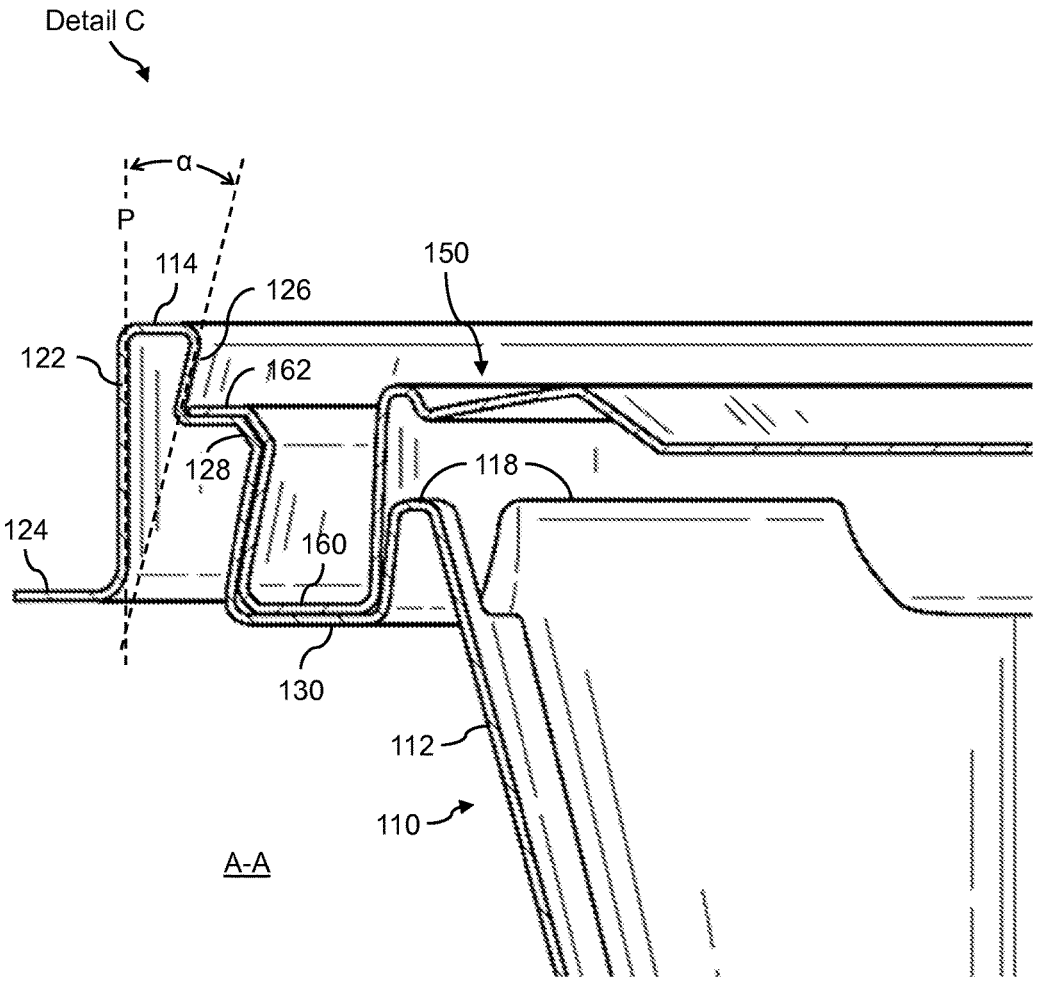
Figure 16:
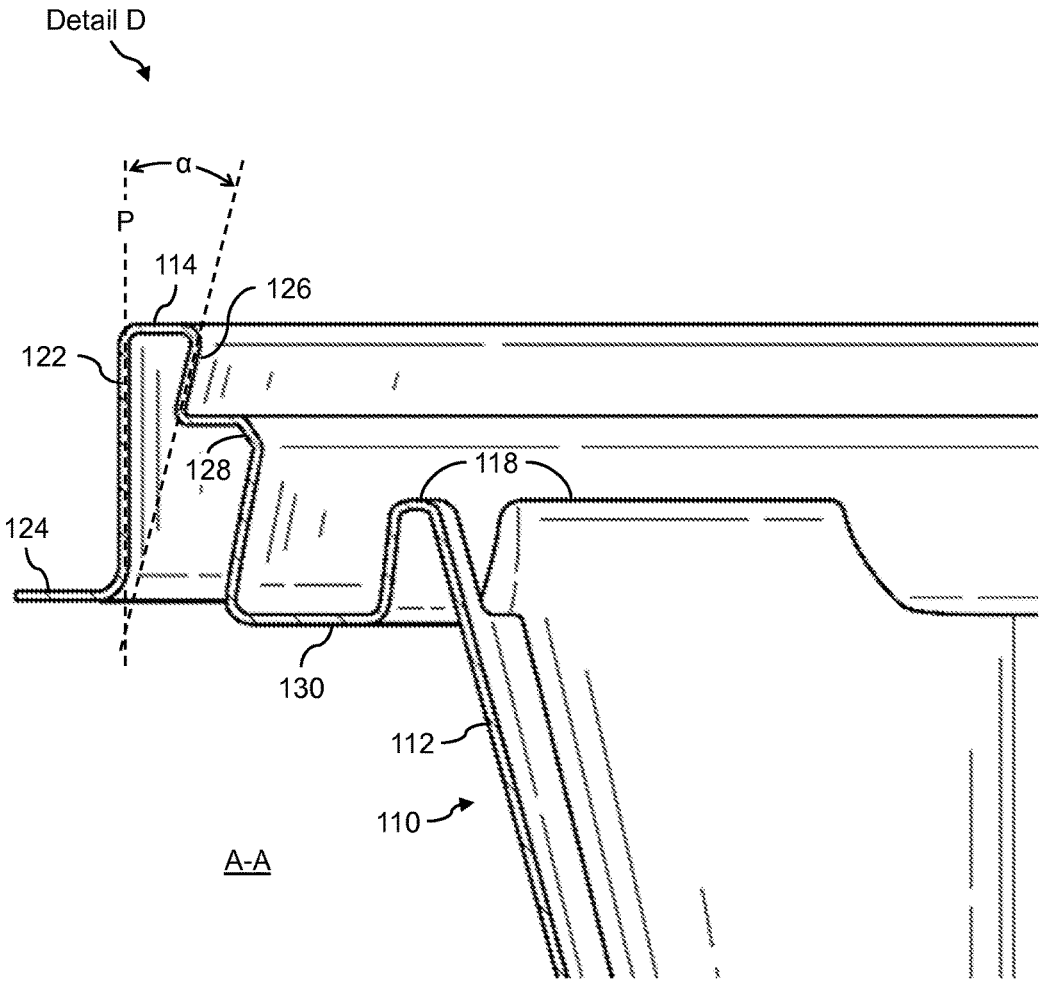
Figure 17:
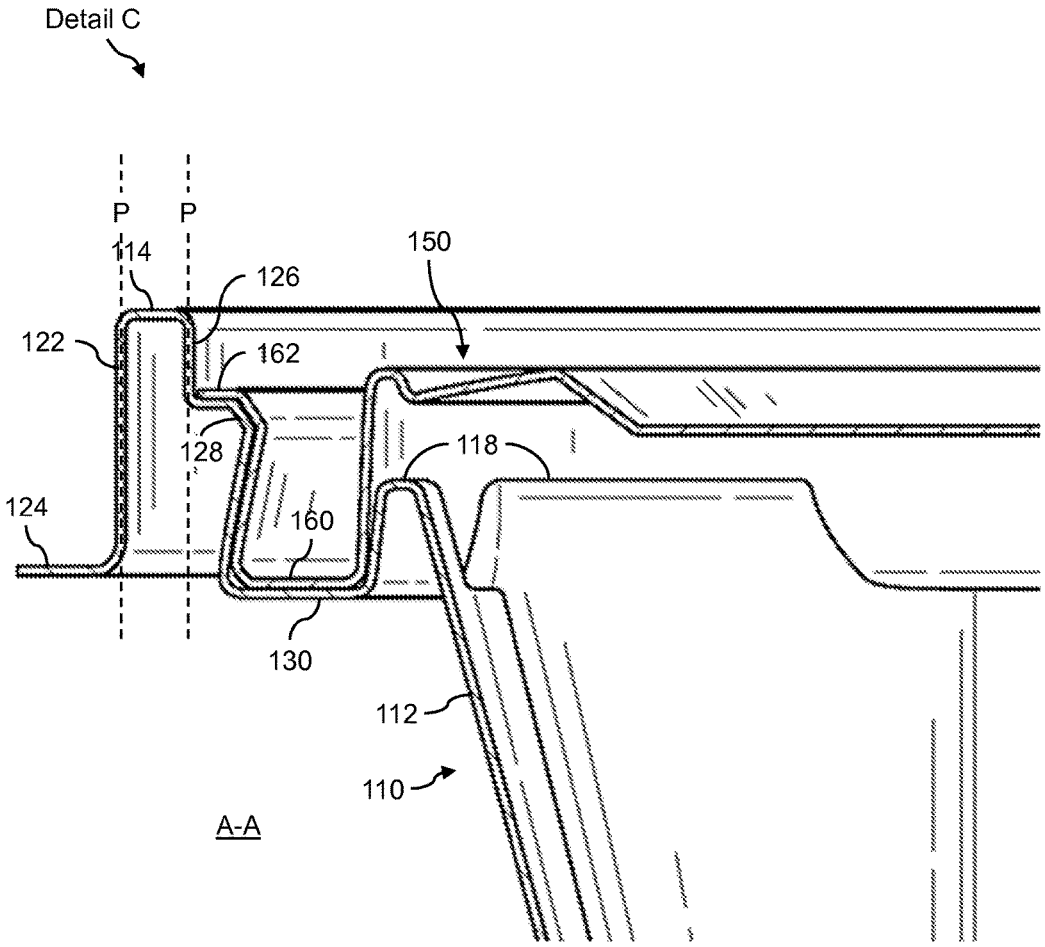
Figure 18:
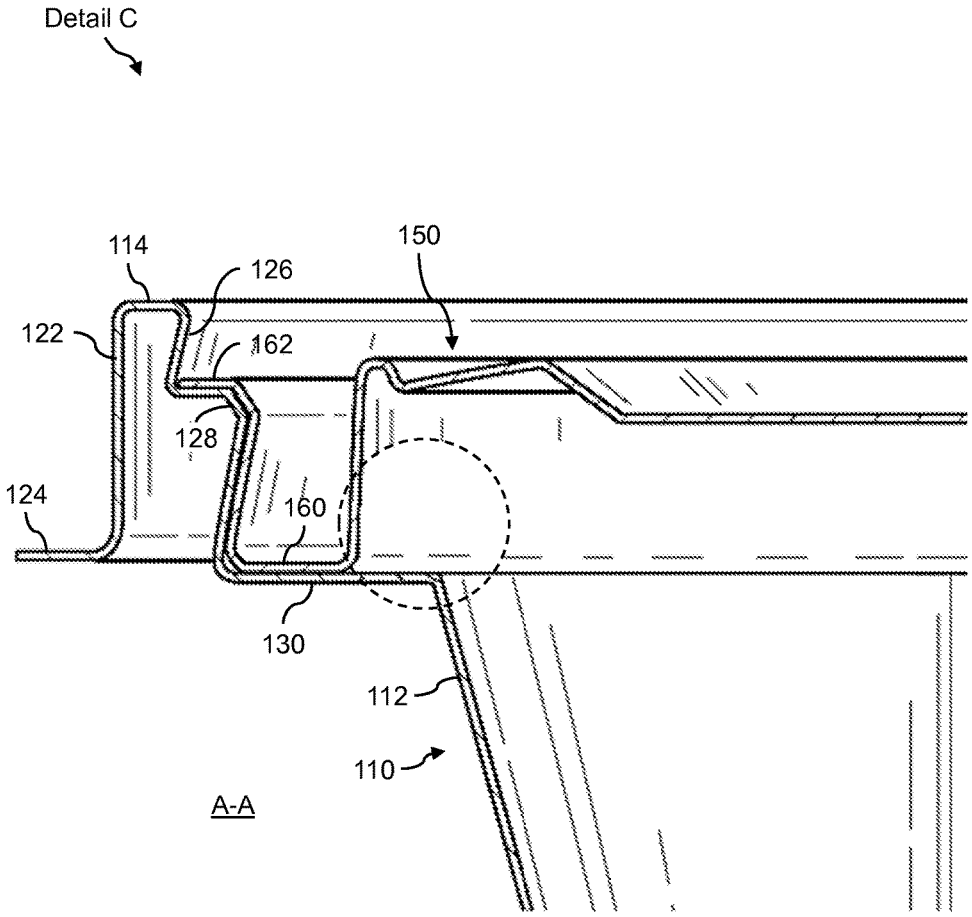
Figure 19:
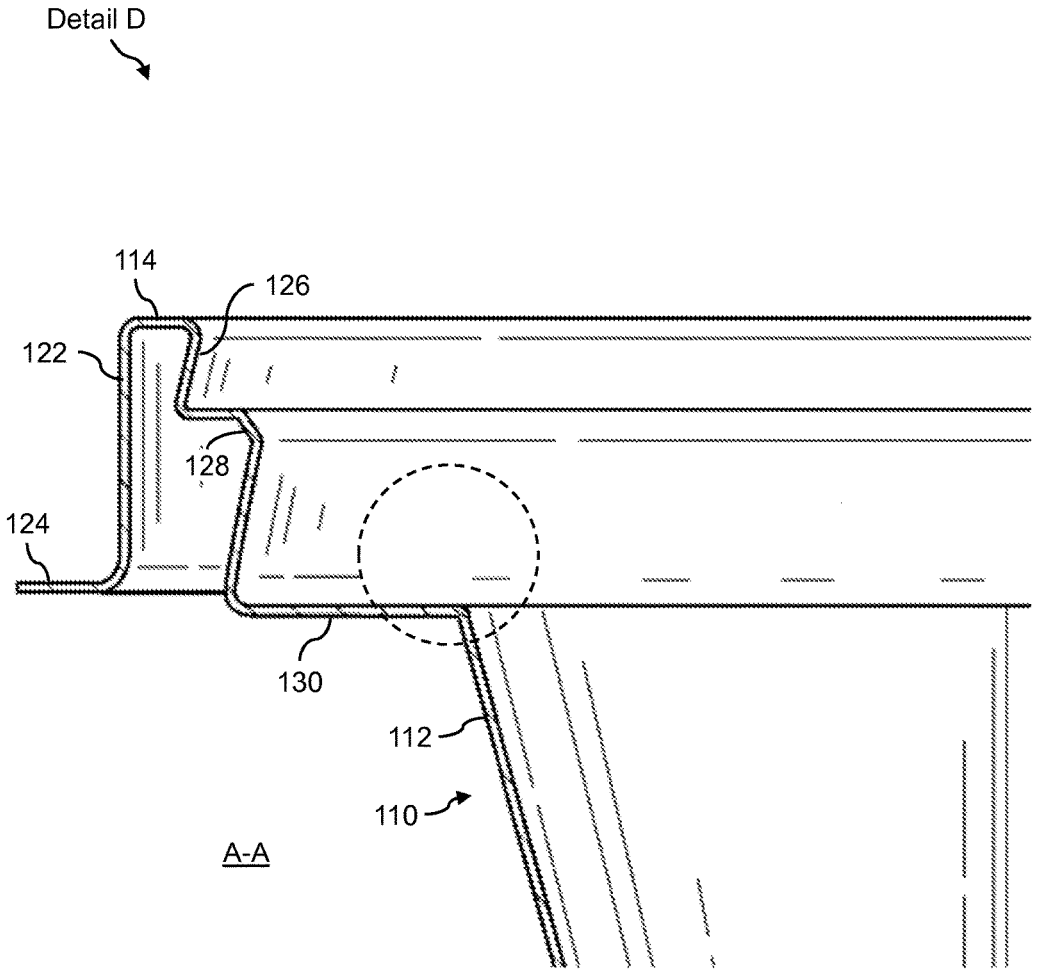
Figure 20:
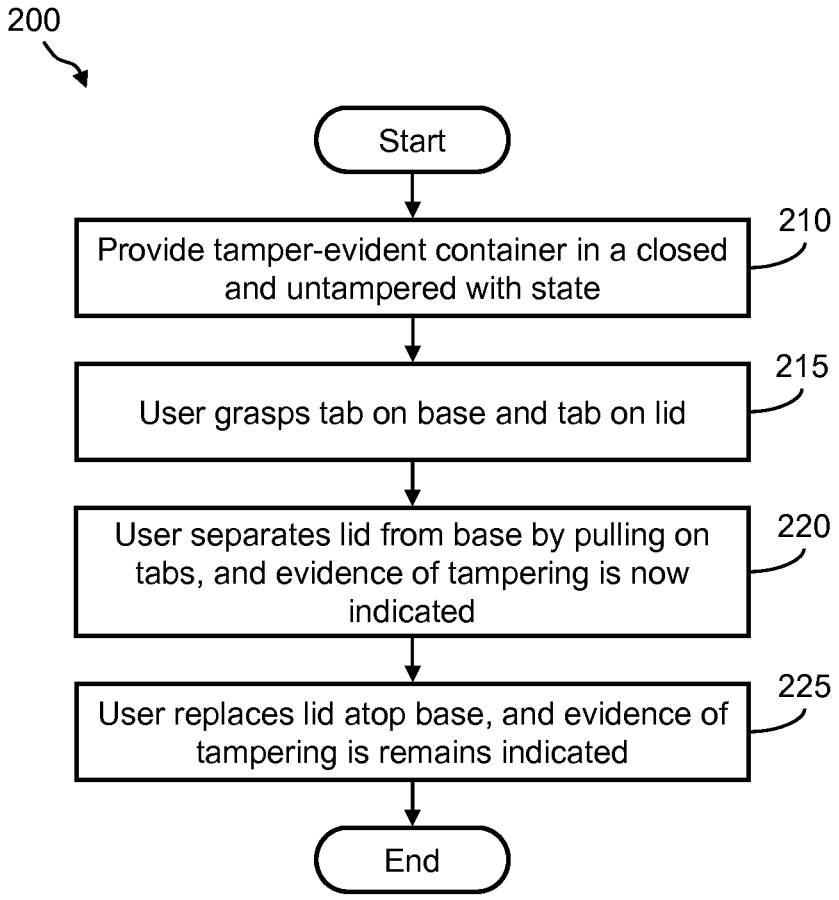

Having thus described the presently disclosed subject matter in general terms, reference will now be made to the accompanying Drawings, which are not necessarily drawn to scale, and wherein:

FIG. 1 illustrates a perspective view of an example of the presently disclosed tamper-evident container when closed;

FIG. 2 illustrates a perspective view of the example tamper-evident container shown in FIG. 1 when opened;

FIG. 3, FIG. 4, and FIG. 5 illustrate three different side views of the example tamper-evident container shown in FIG. 1 when closed;

FIG. 6 illustrates a top down view of the example tamper-evident container shown in FIG. 1 when the container is closed;

FIG. 7 illustrates a bottom up view of the example tamper-evident container shown in FIG. 1 when the container is closed;

FIG. 8 and FIG. 9 illustrate perspective views of the example tamper-evident container shown in FIG. I and in a state in which the tamper-evident features are intact and no evidence of tampering is indicated;

FIG. 10 and FIG. 11 illustrate perspective views of the example tamper-evident container shown in FIG. 1 and in a state in which the tamper-evident features arc not intact and evidence of tampering is indicated;

FIG. 12 illustrates a perspective view of a portion of the base of the example tamper-evident container shown in FIG. 1 showing certain locking features thereof;

FIG. 13 illustrates a cross-sectional view of the example tamper-evident container of FIG. 1 taken along line A-A of FIG. 1, wherein at least one interlocking interface between the base portion and the lid of the tamper-evident container is shown;

FIG. 14 illustrates another cross-sectional view of the tamper-evident container taken along line A-A of FIG. 1, wherein only the base portion of the tamper-evident container is shown;

FIG. 15 and FIG. 16 show close up cross-sectional views of the example tamper-evident container shown in FIG. 1, wherein at least one interlocking interface between the base portion and the lid is shown;

FIG. 17 shows another close up cross-sectional view of the tamper-evident container that shows another example of the interlocking interface between the base portion and the lid;

FIG. 18 and FIG. 19 show yet other close up cross-sectional views of the tamper-evident container that show yet another example of the interlocking interface between the base portion and the lid; and FIG. 20 illustrates a flow diagram of an example of a method of using the presently disclosed tamper-evident container.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a tamper-evident container and method of evidencing tampering with the tamper-evident container. The presently disclosed tamper-evident container is an example of security packaging that incorporates tamper-evident features. The presently disclosed tamper-evident container includes a base portion (base) and a cover portion (or lid). In an untampered with state, one edge of the lid is removably connected to one edge of the base portion.

Namely, the lid includes a tamper-evident tab, wherein the tamper-evident tab includes an upper grasping portion overhanging a lower grasping portion on the base that is flanked by a breakable joint or breakable joints and wherein the lid is removably connected to the base portion via the breakable joint(s) of the tamper-evident tab.

In order to open the tamper-evident container, the grasping portion of the tamper-evident tab is displaced relative to the grasping portion of the base to sever the breakable joint(s), wherein the grasping portion of the tab stays with the lid and the flap portion of the breakable joint(s) stays with the base portion. Accordingly, once the tamper-evident container is opened, the lid is no longer connected to the base portion, rather the lid is detached from the base portion. Further, once the lid is detached from the base portion, upon reclosing the tamper-evident container, the visual observation of the breakable joint(s) being broken is evidence of the tamper-evident container having been opened or tampered with.

Accordingly, an aspect of the presently disclosed tamper-evident container is that the lid includes a tamper-evident tab, wherein the tamper-evident tab includes a grasping overhanging portion that is flanked by breakable joint(s).

Another aspect of the presently disclosed tamper-evident container is that the base portion includes another grasping portion that corresponds to the grasping portion of the tamper-evident tab of the lid. Namely, the base portion includes a recessed tab, wherein the user may grasp both the recessed tab in the base portion and the grasping overhanging portion of the tamper-evident tab of the lid for ease of opening.

Yet another aspect of the presently disclosed tamper-evident container is that in an untampered with state, the breakable joint(s) bend such that when the container is in the closed position, the grasping overhanging portion of the tamper-evident tab moves in toward the container so that the overhang of the grasping portion is close to the base resulting in a minimized footprint.

Still another aspect of the presently disclosed tamper-evident container is that an interlocking interface is provided between the base portion and the lid, wherein the features of the interlocking interface help secure the lid to the base and prevent the lid from opening when the tamper-evident container is closed without evidencing tampering with the container.

In some embodiments, the interlocking interface between the base portion and the lid comprises a ridge in the lid that can be snap-fitted into a corresponding groove in the base portion.

In other embodiments, the interlocking interface between the base portion and the lid comprises a vertex defined in part by an undercut face in the base portion for retaining a lip or flange of the lid, wherein the lip or flange can be reversibly snap-fitted into the vertex of the base portion. For example, an undercut face is provided at the upper peripheral rim (or surround) of the base portion, wherein the undercut face overlaps the lip or flange of the lid to prevent the lid from opening when the tamper-evident container is closed.

In yet other embodiments, the interlocking interface between the base portion and the lid comprises both the ridge in the lid that can be snap-fitted into the groove in the base portion and the vertex defined in part by the undercut face in the base portion for retaining the lip or flange of the lid.

Referring now to FIG. 1 is a perspective view of an example of the presently disclosed tamper-evident container 100 when closed and in an untampered with state, meaning that the tamper-evident features arc intact and no evidence of tampering is indicated. By contrast, FIG. 2 shows a perspective view of the presently disclosed tamper-evident container 100 when opened. Additionally, FIG. 3, FIG. 4, and FIG. 5 show three different side views of tamper-evident container 100 when closed; FIG. 6 shows a top down view of tamper-evident container 100 when closed; and FIG. 7 shows a bottom up view of tamper-evident container 100 when closed. In FIG. 3 through FIG. 7, the presently disclosed tamper-evident container 100 is shown when closed and in an untampered with state. Tamper-evident container 100 is an example of security packaging that incorporates tamper-evident features.

Tamper-evident container 100 can be, for example, a plastic container that includes a base 110 and a lid 150. Accordingly, tamper-evident container 100 can be fabricated any number of ways including being thermoformed. Thermoformed plastic containers arc generally inexpensive and easy to produce.

Base 110 includes a vessel portion 112 for holding a quantity of any product (e.g., foodstuffs, medicine, and the like). A surround portion 114 is provided at the rim or opening of vessel portion 112 of base 110. Surround portion 114 includes certain features (not visible in FIG. 1 through FIG. 6, but shown in FIG. 12 through FIG. 19) for providing an interlocking interface with lid 150. A recessed tab 116 is integrated into one side of surround portion 114 of base 110.

Further, in an untampered with state, one edge of lid 150 is removably connected to one edge of base 110. Namely, lid 150 includes a tamper-evident tab 152, wherein the tamper-evident tab 152 includes a grasping portion 154 that is flanked by breakable joint 155 and wherein lid 150 is removably connected to base 110 via breakable joints 155 of tamper-evident tab 152 and corresponding flap 158 that is connected to base 110. For ease of opening, the user may grasp both the recessed tab 116 in base 110 and the grasping portion 154 of tamper-evident tab 152 of lid 150 and then remove lid 150 from base 110 by tearing or severing the breakable joints 155. In one example, breakable joints 155 comprise a bend 156 defined by perforated line features in the thin plastic material forming tamper-evident container 100. After breaking away lid 150 from base 110, even if reclosed, exposed flaps 158 evidence tampering and indicate a compromised package.

Referring specifically to FIG. 2, which shows the open tamper-evident container 100, certain locking features 118 arc provided on the inside of surround portion 114 of base 110. Further, rib features 120 can be integrated along the sides of vessel portion 112 of base 110. Rib features 120 function as reinforcing members of vessel portion 112 of base 110. FIG. 2 also shows that lid 150 includes a ridge (i.e., an inverted ridge) 160 that has a lip or flange (i.e., a radially projecting peripheral flange) 162 around the perimeter thereof. Ridge 160 is designed to be snap-fitted into corresponding groove (not visible in FIG. 2, but shown in FIG. 12 through FIG. 17). The groove (not shown) in base 110 and ridge 160 in lid 150 is one example of interlocking features of tamper-evident container 100, which form an interlocking interface between base 110 and lid 150.

Tamper-evident container 100 can be any size and any shape. Namely, tamper-evident container 100 can be sized to hold any volume of product. Further, while FIG. 1 through FIG. 7 show that the footprint of tamper-evident container 100 is substantially square, the footprint of tamper-evident container 100 can be any shape, such as, but not limited to, square, rectangular, circular, ovular, triangular, and the like.

Referring now to FIG. 8 and FIG. 9 are perspective views of the tamper-evident container 100 shown in FIG. 1 and in a state in which the tamper-evident features are intact and no evidence of tampering is indicated. Namely, FIG. 9 shows a Detail A of FIG. 8, which is a close up view of tamper-evident tab 152 in the untampered with state. FIG. 8 and FIG. 9 show that each breakable joint 155 includes a tab portion 157, a flap portion 158 (or flap), and a score line or perforation defining a bend 156 between the tab portion 157 and the flap portion 158. When breakable joint or joints 156 are severed, tap portion 157 remains stationarily adjoined to lid 150 flanking grasping portion 154 of tamper-evident tab 152. In some embodiments, when breakable joint or joints 156 are not severed, flap portion 157 partially obstructs a recess defined in part by recessed tab 116. In this way, when a user grasps grasping portion of recessed tab 116, for example, by inserting a thumb into the recess of recessed tab 116, sides of the user's thumb can pull against flap portion 157 to facilitate severing of breakable joint or joints 156 upon displacing grasping portion 154 relative to the grasping portion of recessed tab 116, for example, by lifting grasping portion 154 while holding recessed tab 116. Also shown in FIG. 9 is bend 156 which pulls grasping portion 154 toward the grasping portion of recessed tab 116 when breakable joint or joints 156 arc intact. In the example shown in FIG. 9, breakable joints 155 fold at bend 156 between tab portion 157 and flap portion 158 such that when tamper-evident container 100 is in the closed position, the grasping portion 154 of tamper-evident tab 152 of lid 150 moves inward so that the overhang of grasping portion 154 is close to base 110 resulting in a minimized footprint. More specifically, flaps 158 move toward base 110 for alignment of the interlocking features of base 110 and lid 150. In doing so, grasping portion 154 moves inward toward base 110 to minimize its overhang. This allows for a smaller overall footprint and superior aesthetics. Also see FIG. 6 and FIG. 7 that show the minimized footprint.

Referring now to FIG. 10 and FIG. 11 arc perspective views of the tamper-evident container 100 shown in FIG. 1 and in a state in which the tamper-evident features arc not intact and evidence of tampering is indicated. Namely, FIG. 11 shows a Detail B of FIG. 10, which is a close up view of tamper-evident tab 152 in a compromised state. Namely, even if lid 150 is reclosed upon base 110, the exposed flaps 158 evidence tampering with the container 100 and indicate a compromised package. In some embodiments, when breakable joint or joints 156 are severed, flap portion or portions 158 remain hingeably adjoined to base 110, thereby evidencing tampering with the container.

FIG. 11 also shows indicia on grasping portion 154 of tamper-evident tab 152 and on grasping portion of recessed tab 116. For example, as shown in FIG. 11 indicia on grasping portion 154 visually cues a user to lift tamper-evident tab 152 and indicia on grasping portion of recessed tab 116 visually cues a user to hold or grasp recessed tab 116. In the example shown in FIG. 11, the tamper-evident container instructs a user of the tamper-evident container 100 to displace grasping portion 154 relative to grasping portion of recessed tab 116, for example, by visually cueing the user to hold grasping portion of recessed tab 116 (i.e., by grasping) and by visually cueing the user to lift the tamper-evident tab 152 (i.e., by grasping and pulling grasping portion 154 away from recessed tab 116) while the user is holding grasping portion of recessed tab 116.

Referring now to FIG. 12 is a perspective view of a portion of base 110 of tamper-evident container 100, which is base 110 absent surround portion 114 but including a plurality of repeating plateaus 118 which act as locking features. The plurality of repeating plateaus or locking features 118 form one wall of the groove (shown in FIG. 12 through FIG. 17) in base 110 that is designed to receive ridge 160 of lid 150. FIG. 12 shows gaps between the locking features 118. However, in other embodiments, the gaps arc omitted and base 110 includes one continuous plateau or locking feature 118.

Referring now to FIG. 13 is a cross-sectional view of the tamper-evident container 100 taken along line A-A of FIG. 1. Further, FIG. 14 shows another cross-sectional view of the tamper-evident container 100 taken along line A-A of FIG. 1, wherein the tamper-evident container 100 is absent lid 150.

Referring now to FIG. 15 and FIG. 16 arc close up cross-sectional views of the tamper-evident container 100 that show an example of the interlocking interface between the base and the lid. Namely, FIG. 15 shows a Detail C of FIG. 13, which is a close up view of one edge of tamper-evident container 100 and showing more details of the interlocking interface between base 110 and lid 150. FIG. 16 shows a Detail D of FIG. 14, which is a close up view of one edge of tamper-evident container 100 absent lid 150.

Surround portion 114 of base 110 includes an outer peripheral face or wall 122. A lip or flange 124 is at the lower portion of outer peripheral face or wall 122 of surround portion 114. Surround portion 114 of base 110 also includes an inner peripheral face or wall 126. FIG. 15 and FIG. 16 shows that inner peripheral face or wall 126 of surround portion 114 has a stepped portion 128 that defines one wall or face of a groove 130. The opposite wall or face of groove 130 is defined by the plurality of repeating plateaus or locking features 118. FIG. 15 shows ridge 160 of lid 150 fitted inside groove 130 of base 110. In this example, both groove 130 of base 110 and ridge 160 of lid 150 are instantiated as U-channels. However, groove 130 of base 110 and ridge 160 of lid 150 are not limited to being U-channels. Groove 130 of base 110 and ridge 160 of lid 150 can have any geometry as long as they have corresponding shapes that can be fitted together and provide locking action.

Additionally, as shown in FIG. 15 the interlocking interface comprises a lock formed between inner peripheral face or wall of surround portion 114 and radially projecting peripheral flange 162. FIG. 15 shows that inner peripheral face or wall of surround portion 114 has an undercut face portion 126 and a stepped portion 128 combining to form a vertex therebetween. For example, if outer peripheral face or wall 122 of surround portion 114 is set on a plane P, then undercut face portion 126 of inner peripheral face or wall of surround portion 114 is set on an angle $\alpha$ with respect to the plane P. The angle $\alpha$ can range from about 7 degrees to about 24 degrees. In some embodiments, the angle $\alpha$ is about 7 degrees with respect to plan P. In some embodiments, the angle $\alpha$ is about 8 degrees with respect to plan P. In some embodiments, the angle $\alpha$ is about 9 degrees with respect to plan P. In some embodiments, the angle $\alpha$ is about 10 degrees with respect to plan P. In some embodiments, the angle $\alpha$ is about 11 degrees with respect to plan P. In some embodiments, the angle $\alpha$ is about 12 degrees with respect to plan P. In some embodiments, the angle $\alpha$ is about 13 degrees with respect to plan P. In one example, angle $\alpha$ is about 14 degrees. In some embodiments, the angle $\alpha$ is about 15 degrees with respect to plan P. In some embodiments, the angle $\alpha$ is about 16 degrees with respect to plan P. In some embodiments, the angle $\alpha$ is about 17 degrees with respect to plan P. In some embodiments, the angle $\alpha$ is about 18 degrees with respect to plan P. In some embodiments, the angle $\alpha$ is about 19 degrees with respect to plan P. In some embodiments, the angle $\alpha$ is about 20 degrees with respect to plan P. In some embodiments, the angle $\alpha$ is about 21 degrees with respect to plan P. In some embodiments, the angle $\alpha$ is about 22 degrees with respect to plan P. In some embodiments, the angle $\alpha$ is about 23 degrees with respect to plan P. In some embodiments, the angle $\alpha$ is about 24 degrees with respect to plan P.

At the same time that ridge 160 of lid 150 is snap-fitted into groove 130 of base 110, radially projecting peripheral lip or flange 162 of ridge 160 engages with the undercut portion of inner peripheral face or wall 126 of surround portion 114 of base 110, as shown. When engaged with the undercut, lip or flange 162 of ridge 160 rests atop step feature 128 of surround portion 114. In some embodiments, the radially projecting peripheral flange 162 is reversibly snap-fitted into the vertex.

Accordingly, while ridge 160 of lid 150 engaging with groove 130 of base 110 is one example of interlocking features that form an interlocking interface between base 110 and lid 150, lip or flange 162 of ridge 160 engaging with the undercut in the surround portion 114 of base 110 is another example of interlocking features that form an interlocking interface between base 110 and lid 150.

In other embodiments of tamper-evident container 100, the undercut at inner peripheral face or wall 126 of surround portion 114 of base 110 is omitted, as shown in FIG. 17. In this example, inner peripheral face or wall 126 of surround portion 114 of base 110 is substantially parallel to the plane P of outer peripheral face or wall 122 of surround portion 114. In this example, the interlocking interface between base 110 and lid 150 relies on ridge 160 in lid 150 engaging with groove 130 in base 110.

In still other embodiments of tamper-evident container 100, the plurality of repeating plateaus or locking features 118 of base 110 are omitted, as shown in FIG. 18 and FIG. 19. In this example, one wall of ridge 160 in lid 150 fits against the inner peripheral face or wall of surround portion 114, still providing some locking action, in combination with lip or flange 162 of ridge 160 engaging with the undercut in the surround portion 114 of base 110. FIG. 18 shows both base 110 and lid 150, while FIG. 19 shows base 110 alone absent the locking features 118 of base 110.

Referring now to FIG. 20 is a flow diagram of a method 200, which is an example of a method of using the presently disclosed tamper-evident container 100. Method 200 may include, but is not limited to, the following steps.

At a step 210, tamper-evident container 100 is provided in a closed and untampered with state, meaning that the tamper-evident features arc intact and no evidence of tampering is present and/or indicated. Further, in this state, ridge 160 of lid 150 is engaged within groove 130 of base 110 and lip or flange 162 of ridge 160 is engaged with the undercut in the surround portion 114 of base 110.

At a step 215, the user grasps recessed tab 116 of base 110 with one hand and also grasps grasping portion 154 of tamper-evident tab 152 of lid 150 with the other hand.

At a step 220, the user pulls recessed tab 116 of base 110 and grasping portion 154 of tamper-evident tab 152 of lid 150 in opposite directions. In so doing, the breakable joints 156 are broken and lid 150 is separated from flaps 158 that are connected to base 110. Further, in so doing, ridge 160 of lid 150 is disengaged from groove 130 of base 110 and lip or flange 162 of ridge 160 is disengaged from the undercut in the surround portion 114 of base 110, thereby allowing lid 150 to be separated from base 110. At the completion of this step, the exposed flaps 158 is evidence of tampering and indicates a compromised package.

At a step 225, the user replaces lid 150 atop base 110. Namely, ridge 160 of lid 150 is re-engaged with groove 130 of base 110 and lip or flange 162 of ridge 160 is reengaged with the undercut in the surround portion 114 of base 110 thereby securing lid 150 atop base 110. At the completion of this step, even though tamper-evident container 100 is reclosed, the exposed flaps 158 evidence tampering with the container and indicate a compromised package.

In an aspect, the presently disclosed subject matter provides a method of evidencing tampering with a presently disclosed tamper-evident container. The method includes (a) providing a tamper-evident container, the tamper-evident container, (b) instructing a user of the tamper-evident container to grasp a first grasping portion and/or a second grasping portion of the tamper-evident container, and (c) evidencing tampering with the container when the second grasping portion is displaced relative to the first grasping portion until at least one of the tab portions is partially separated from at least one of the flap portions. In some embodiments, the tamper-evident container of use in the method includes (i) a base comprising a recessed tab, the recessed tab comprising a first grasping portion, (ii) a lid comprising a tamper-evident tab at least partially overhanging the recessed tab, the tamper-evident tab comprising a second grasping portion flanked by breakable joints between the base and the lid, the breakable joints each comprising a tab portion that remains stationarily adjoined to the lid when the breakable joints are severed, and a flap portion that remains hingeably adjoined to the base when the breakable joints are severed, and (iii) an interlocking interface formed between the base and the lid. When the container is closed the interlocking interface renders contents inside the tamper-evident container relatively inaccessible without severing the breakable joints and/or evidencing tampering with the container. The breakable joints are at least partially severed by displacing the second grasping portion relative to the first grasping portion until at least one of the tab portions is partially separated from at least one of the flap portions, thereby evidencing tampering with the container. That is, the tamper-evident container evidences tampering with the container when the user grasps the first grasping portion and/or the second grasping portion and displaces the second grasping portion relative to the first grasping portion until at least one of the tab portions is partially separated from at least one of the flap portions. As used herein, "partially separated" means at least a portion of one of the tab portions is separated from at least a portion of the corresponding flap portions in a manner that is apparent upon visual inspection by a user. In some embodiments, step (b) of instructing the user of the tamper-evident container to grasp the first grasping portion and/or the second grasping portion comprises providing indicia on the first grasping portion and/or the second grasping portion that visually cues the user to grasp the first grasping portion and/or the second grasping portion. In some embodiments, the indicia visually cue the user to displace the first grasping portion relative to the second grasping portion.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations arc appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes ail numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

As used herein, the terms "relatively inaccessible" and "substantially inaccessible" in the context of the interlocking interface of the presently disclosed tamper-evident container mean that the lock formed by the features of the interlocking interface prevent the tamper-evident container from being opened without first at least partially severing the breakable joint(s) and/or evidencing tampering with the container, for example, the radially projecting flange of the lid is composed of a thin deformable plastic that will deform (e.g., bend, ruffle, wrinkle, etc.) when an attempt is made open the container (e.g., by prying) without first at least partially severing the breakable joints(s), thereby evidencing tampering with the container. As such, in addition to the breakable joint(s) which themselves evidence tampering with the container upon partial severing, the radially projecting flange also evidences tampering with the container if access to the contents inside the container is sought by tampering without first at least partially severing the breakable joint(s). As used herein, the term "joint(s)" means a single joint, or multiple joints, for example, two breakable joints. As used herein, "at least partially severing" of a breakable joint means that at least one point of contact between the tab portion and the flap portion at the bend defined by the score line or perforation is severed. Although the foregoing subject matter has been described in some detail by way of illustration and example for purposes of clarity of understanding, it will be understood by those skilled in the art that certain changes and modifications can be practiced within the scope of the appended claims.

What is claimed is:

1. A tamper-evident container positionable in an open state and in a closed state; the container comprising:

(a) a base having a rim with a recess for providing a first grasping portion;

(b) a lid comprising a tamper-evident tab at least partially overlapping with the recess and offset from the recess when the container is in the closed state such that the tamper-evident tab is at least partially overhanging the recess, the tamper-evident tab comprising a second grasping portion flanked by a first breakable joint between the base and the lid and a second breakable joint between the base and the lid that flanks the tamper-evident tab; and (c) an interlocking interface formed between the base and the lid, wherein when the container is in the closed position the interlocking interface renders contents inside the container substantially inaccessible without severing the first breakable joint and/or evidencing tampering with the container; and wherein the first breakable joint is at least partially severed when the second grasping portion is displaced relative to the first grasping portion, thereby evidencing tampering with the container, wherein the first breakable joint and the second breakable joint each comprise:

(i) a tab portion, (ii) a flap portion, and a score line or perforation defining a bend between the tab portion and the flap portion.

2. The tamper-evident container of claim 1, wherein the recess further comprises a recessed tab for receiving a fingertip and a wall portion onto which one portion of the fingertip rests when an adjacent portion of the same fingertip is used to grasp the first grasping portion.

3. The tamper-evident container of claim 2, wherein when the first breakable joint and/or the second breakable joint is severed, the tab portion remains stationarily adjoined to the lid, and the flap portion remains hingeably adjoined to the base, thereby evidencing tampering with the container.

4. The tamper-evident container of claim 2, wherein when the first breakable joint and/or the second breakable joint is not severed, the flap portion partially obstructs a recess defined in part by the recessed tab.

5. The tamper-evident container of claim 1, wherein when the first breakable joint and/or the second breakable joint is intact, the bend pulls the second grasping portion toward the first grasping portion.

6. The tamper-evident container of claim 1, wherein the lid further comprises a radially projecting peripheral flange adjoining the tamper-evident tab, and wherein the base further comprises a surround portion surrounding the lid when the container is closed, the surround portion comprising an outer peripheral face that is parallel to a plane P, and an inner peripheral face opposite the outer peripheral face.

7. The tamper-evident container of claim 6, wherein the interlocking interface comprises a lock formed between an inverted ridge positioned adjacent to the radially projecting peripheral flange of the lid and a groove positioned adjacent to the inner peripheral face of the surround portion of the base.

8. The tamper-evident container of claim 7, wherein the inner peripheral face comprises a stepped portion, and wherein the groove is defined in part by the stepped portion.

9. The tamper-evident container of claim 8, wherein the base comprises a plurality of repeating plateaus opposite the stepped portion, and the groove is further defined in part by the plurality of repeating plateaus.

10. The tamper-evident container of claim 9, wherein the inverted ridge is reversibly snap-fitted into the groove.

11. The tamper-evident container of claim 6, wherein the interlocking interface comprises a lock formed between the inner peripheral face and the radially projecting peripheral flange.

12. The tamper-evident container of claim 11, wherein the inner peripheral face comprises an undercut face portion and a stepped face portion combining to form a vertex therebetween.

13. The tamper-evident container of claim 12, wherein the radially projecting peripheral flange is reversibly snap-fitted into the vertex.

14. The tamper-evident container of claim 13, wherein the undercut face portion is set at an angle $\alpha$ of about 14° relative to the plane P.

15. A tamper-evident container positionable in an open state and in a closed state;

the container comprising:

(a) a base having a rim with a recess for providing a first grasping portion;

(b) a lid comprising a tamper-evident tab at least partially overlapping with the recess and offset from the recess when the container is in the closed state such that the tamper-evident tab is at least partially overhanging the recess, the tamper-evident tab comprising a second grasping portion flanked by breakable joints between the base and the lid; and (c) an interlocking interface formed between the base and the lid, wherein when the container is in the closed position the interlocking interface renders contents inside the container relatively inaccessible without severing the breakable joints and/or evidencing tampering with the container; and wherein the breakable joints are at least partially severed when the second grasping portion is displaced relative to the first grasping portion, thereby evidencing tampering with the container, wherein the breakable joints each comprise:

(i) a tab portion, (ii) a flap portion, and a score line or perforation defining a bend between the tab portion and the flap portion.

16. The tamper-evident container of claim 15, wherein:

when the breakable joints are severed, the tab portions remain stationarily adjoined to the lid, and the flap portions remains hingeably adjoined to the base, thereby evidencing tampering with the container;

when the breakable joints are intact, the flap portions partially obstructs a recess defined in part by the recessed tab; and when the breakable joints arc intact, the bends pull the second grasping portion toward the first grasping portion, thereby minimizing the footprint of the container.

17. The tamper-evident container of claim 15, wherein the lid further comprises a radially projecting peripheral flange adjoining the tamper-evident tab, wherein the base further comprises a surround portion surrounding the lid when the container is closed, the surround portion comprising an outer peripheral face that is parallel to a plane P, and an inner peripheral face opposite the outer peripheral face, and wherein the inner peripheral face comprises an undercut face portion and a stepped face portion.

18. The tamper-evident container of claim 17, wherein the base further comprises a groove that is defined on one side by the stepped face portion and is defined on the opposite side by a plurality of repeating plateaus, wherein the lid further comprises an inverted ridge positioned adjacent the radially projecting peripheral flange, and wherein the interlocking interface comprises a lock formed by the reversible snap-fitted engagement between the inverted ridge and the groove when the container is closed.

19. The tamper-evident container of claim 17, wherein the undercut face portion is set at an angle $\alpha$ relative to the plane P, thereby forming a vertex between the undercut face portion and the stepped face portion of the inner peripheral face, wherein the interlocking interface comprises a lock formed by the reversible snap-fitted engagement between the radially projecting flange and the vertex when the container is closed.

20. A method of evidencing tampering with a tamper-evident container positionable in an open state and in a closed state, the method comprising:

(a) providing a tamper-evident container, the tamper-evident container comprising:

(i) a base having a rim with a recess providing a first grasping portion;

(ii) a lid comprising a tamper-evident tab at least partially overlapping with the recess and offset from the recess when the container is in the closed state such that the tamper-evident tab is at least partially overhanging the recess, the tamper-evident tab comprising a second grasping portion flanked by breakable joints between the base and the lid, the breakable joints each comprising a tab portion that remains stationarily adjoined to the lid when the breakable joints are severed, and a flap portion that remains hingeably adjoined to the base when the breakable joints arc severed; and (iii) an interlocking interface formed between the base and the lid, wherein when the container is in the closed position the interlocking interface renders contents inside the tamper-evident container inaccessible without severing the breakable joints and/or evidencing tampering with the container, and wherein the breakable joints are at least partially severed by displacing the second grasping portion relative to the first grasping portion until at least one of the tab portions is partially separated from at least one of the flap portions, thereby evidencing tampering with the container;

(b) instructing a user of the tamper-evident container to grasp the first grasping portion and/or the second grasping portion; and (c) evidencing tampering with the container when the second grasping portion is displaced relative to the first grasping portion until at least one of the tab portions is partially separated from at least one of the flap portions.

* * * * *